United States Patent [19]

Wilson

[11] Patent Number: 4,999,052

[45] Date of Patent: Mar. 12, 1991

[54] METHOD OF PRODUCING NITROGEN-STRENGTHENED ALLOYS

[75] Inventor: Eric G. Wilson, Preston, United Kingdom

[73] Assignee: United Kingdon Atomic Energy Authority, London, United Kingdom

[21] Appl. No.: 409,736

[22] Filed: Sep. 20, 1989

[30] Foreign Application Priority Data

Oct. 5, 1988 [GB] United Kingdom ..... 8823430
Jan. 18, 1989 [GB] United Kingdom ..... 8901031

[51] Int. Cl.[5] ..... C22C 1/05

[52] U.S. Cl. ..... 75/338; 75/363; 148/126.1

[58] Field of Search ..... 75/238, 363; 148/126.1

[56] References Cited

U.S. PATENT DOCUMENTS

Re. 31,767 12/1984 Brooks ..... 164/46
4,582,679 4/1986 Wilson et al. ..... 420/421
4,708,742 11/1987 Wilson ..... 75/252

OTHER PUBLICATIONS

Patent Abracts of Japan, vol. 12, No. 28 (C-471), 27th Jan. 1988, Japan, Patent Application No. 62177157 (Mitsubishi).

*Primary Examiner*—Deborah Yee
*Attorney, Agent, or Firm*—William R. Hinds

[57] ABSTRACT

Nitrogen-strengthened alloys, especially steels, are produced by heating a combination of metal particles and a nitrogen donor, such as a chromium nitride, to make nitrogen available as a solute in the particles. The particles may be produced as a permeable preform for the process. The dissolved nitrogen leads to improved hardness, and higher strength is additionally obtained by the inclusion of a dispersant, such as yttria, in the particles.

25 Claims, 1 Drawing Sheet

METHOD OF PRODUCING NITROGEN-STRENGTHENED ALLOYS

Figure 1:
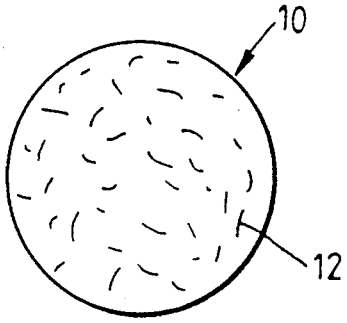

This invention relates to nitrogen-strengthened alloys and the production thereof.

According to the present invention, a method of producing a nitrogen-strengthened alloy comprises, heating a combination comprising metal particles or a permeable agglomeration thereof and a nitrogen donor to effect dissociation of at least part of the nitrogen donor and thereby make nitrogen available as a solute in at least some of the particles.

Preferably, the donor is distributed on the surface of said particles or within said particles, or on pore surfaces within a said agglomeration.

The particles may include a nitride former such as titanium therein, and the heating may cause some of the available nitrogen to react with the nitride former to provide a fine dispersion of the nitrided said former, for example titanium nitride.

The particles may also include a dispersant for strengthening the particles, which dispersant for example might be a nitride such as titanium nitride, or an oxide such as yttria.

The combination might be made by forming the donor about the particles, or mechanically alloying the donor within the particles. Alternatively, the metal particles may be in the form of a permeable body thereof formed by the agglomeration of said metal particles and the donor may be formed within the body on pore surfaces thereof.

In one application of the invention, the heating is effected during hot consolidation of the particles.

The invention has advantages in the manufacture of stainless steels, for example austenitic stainless steels.

The nitrogen donor may comprise a metallic nitride which dissociates within the temperature range of 500° C. to 1300° C. The preferred nitrogen donor is a chromium nitride, for example as CrN and/or $Cr_2N$, although other nitrides, for example iron nitride, may be suitable.

Typically, the combination may be heated to a temperature in excess of 1000° C. to effect dissociation of the nitrogen donor such as chromium nitride. Such heating may be carried out under pressure.

Since the quantity and type of nitrogen donor (and, where a nitride dispersion is produced, the nitride former) can be precisely determined in the starting alloy combination, the method provides the means of closely controlling the amount of nitrogen which is available to remain as a solute in the particles and thereby forming an alloy therewith. Consequently the method also provides improved flexibility in alloy design. Preferably a nitrogen content in the alloy of about 0.01% to 0.3% by weight is aimed at, although higher or lower levels are possible depending upon the particular alloy composition and application envisaged. It is preferred that any carbon in iron-containing alloys does not exceed 0.03% and desirably is less than 0.01% to inhibit the formation of embrittling precipitates during high temperature operations.

Heating to effect dissociation of the nitrogen donor may be conveniently carried out in the course of hot consolidation of the particles, for example in hot isostatic pressing or hot extrusion.

The invention provides a convenient method for making a range of steel alloys especially useful across a wide temperature range including use in cryogenic environments, and which benefit from the strengthening and other improved properties such as hardening due to the presence of nitrogen in solid solution in the alloy. When combined with the use of a nitride former in the starting metal particle and/or the addition of strengthening dispersants such as nitrides, especially titanium nitride or oxides especially yttria, the method also provides a simple and convenient way of combining the beneficial effects of dispersion strengthening, particularly in the case of titanium nitride, with the strengthening and hardening effect of dissolved nitrogen introduced in controlled and predicted amounts.

The invention provides steel alloys, for example austenitic stainless steels, comprising nitrogen in solid solution, preferably wherein the alloy additionally comprises a strengthening dispersant. Such strengthening dispersant may comprise a nitride, for example titanium nitride, and/or an oxide, for example yttria. Such steel alloys preferably contain 0.01%–0.3% by weight of nitrogen in solid solution and less than 0.03% by weight, more preferably less than 0.01% by weight, of carbon.

Steels made by the method of the invention, may have applications as fasteners, valve parts, gears, actuators, etc, and other components having improved tribological properties derived from enhanced strength and hardness. Improved resistance to pitting, and to corrosion from aqueous, caustic and weak acid solutions enables such steels to be used in the food industry. They may also have applications in the nuclear field for reactor components such as cladding, grids, and braces, and for reprocessing plant components etc.

Figure 2:
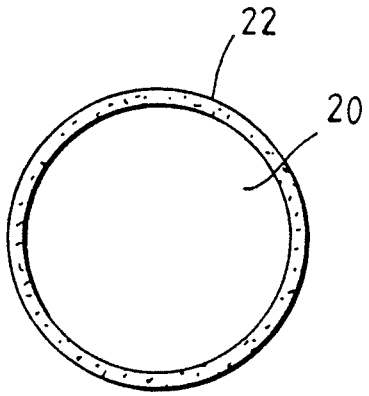
Figure 3:
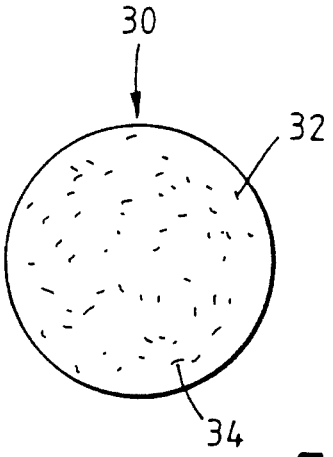

The invention will now be further described by way of example only with reference to the accompanying drawing, in which:

FIGS. 1 to 3 show sectional represention to an enlarged scale of metal particles.

Referring now to FIG. 1, a stainless steel (e.g. 20/25) particle 10 (e.g. 50 microns) is shown. The particle 10 includes a nitrogen donor 12 such as chromium nitride(s) incorporated in the particle 10 by mechanical alloying in a nitrogen environment, for example by the method described in British Patent Specification No 2183676A (U.S Pat. No. 4708742) and in Metals Handbook, 9th edition, volume 7: Powder Metallurgy (see pages 722–726), which are incorporated by reference herein.

In FIG. 2 a stainless steel particle 20 is shown with a layer 22 of a nitrogen donor such as chromium nitride(s) about the particle 20. The layer 22 may be formed by the method described in British Patent Specification No 2156863A (U.S. Pat. No. 4582679) which are incorporated by reference herein. In this method a donor such as chromium nitride(s) is made by reacting the chromium present in the stainless steel with a gas comprising nitrogen and hydrogen, e.g. ammonia, to form chromium nitride(s), the reaction preferably being carried out at about 700° C.

FIG. 3 shows a stainless steel particle 30 containing elemental titanium as a solute to provide a nitride former, and a nitrogen donor 32 such as chromium nitride(s) incorporated by the aforesaid mechanical alloying.

When the particles 10, 20, 30 respectively of FIGS. 1, 2, and 3 are heated typically above 1000° C., the donor 12, 22, 32 dissociates and nitrogen is released into the respective particle 10, 20, 30. In FIG. 1, the released nitrogen enters into a solid solution in the particle 10. In FIG. 2 the released nitrogen diffuses into the particle 20 to form a solid solution therein. In FIG. 3, the released nitrogen reacts with the titanium nitride former to form a dispersed nitride 34 (e.g. titanium nitride), and also enters into solid solution in the particle 30. Hence in each of the particles 10, 20, 30 there is a strengthening and hardening effect due to the nitrogen in solid solution, and in the particle 30 there is a cumulative effect from the nitrogen in solid solution, and the dispersed nitrided former 34.

It will be understood that the particles 10, 20, 30 may include a dispersed nitride such as titanium nitride and/or another dispersant which may be an oxide such as yttria and included in the particles by methods known in the art, such as the aforementioned mechanical alloying. The particle 30 may have the nitrogen donor in the form of the layer 22 of FIG. 2.

Examples of stainless steel starting materials and nitrogen donors are conveniently shown in Table 1.

As an alternative to the particles of FIGS. 1 to 3, a permeable agglomeration of metal particles may be used such as that produced by the so-called 'Osprey' process. The Osprey process involves atomising a molten stream of an alloy by the use of gas jets, and causing the semi-molten particles to impinge on a collector such as a plate or rotating former, which can be arranged to produce a permeable preform. Such a preform of stainless steel may be infiltrated with a gas such as ammonia to form chromium nitride(s) on pore surfaces within the preform and subsequently hot consolidated in a similar manner to that described in relation to FIG. 2.

In one modification of the 'Osprey' process a chromium nitride powder is injected into the atomising gas so as to be dispersed in the preform.

In a second modification of the 'Osprey' process the atomising gas may comprise a nitrogenous gas, and the collecting plate or rotating former maintained in a nitrogenous atmosphere so that chromium nitride is formed in the preform. Ammonia is one example of a suitable nitrogenous gas.

Heating the preform above about 1100° C. (depending on the nitrogen partial pressure) causes the chromium nitride to dissociate, with the result that nitrogen is released to enter into solid solution in the particles of the preform. This heating might be produced during further processing by hot extrusion or forging.

Such modifications of the 'Osprey' process have considerable flexibility in that layers of different composition can be deposited, so that the properties of a component such as a tube can be matched to the needs of internal and external environments.

One example of a stainless steel produced is a 20 Cr, 25 Ni, TiN, N austenitic stainless steel.

The nitriding reaction $Cr_2N+Ti \rightarrow TiN+2Cr$ may commence during atomising but will slow down as the hot preform cools.

A suitable preform might also be made by lightly sintering metal particles or compacting them with a binder, and the preform might be near to the end shape required as the product or for further processing.

The invention may have applications for other alloys such as nickel-based alloys to produce a controlled specific release of nitrogen into the alloy.

TABLE

| STARTING MATERIAL | NITROGEN DONOR | DONOR INTRODUCTION | LOCATION OF DONOR |
|---|---|---|---|
| 1a. 20/25/Ti constituents | $Cr_2N$ | Mechanically alloy | Within each powder particle |
| b. 20/25 alloy 38–76 microns | $CrN/Cr_2N$ | $NH_3$-nitride at about 973 K | Surface layer on each powder particle |
| c. 20/25/ Ti alloy permeable aggregate | $CrN/Cr_2N$ | $NH_3$-nitride at about 973 K | On open pore surfaces |
| 2. 20/25/TiN constituents | $Cr_2N$ | Mechanically alloy | Within each powder particle |
| 3. 20/25* | $Cr_2N$ or $CrN/Cr_2N$ | As 1a, b or c, or 2 | See above |
| 4. ODS+ alloy constituents | $Cr_2N$ | Mechanically alloy | Within each powder particle |

| STARTING MATERIAL | TiN FORMATION/ NITROGEN ALLOYING | STRENGTHENING DISPERSANT |
|---|---|---|
| 1a. 20/25/Ti constituents | During heating for consolidation | TiN |
| b. 20/25 alloy 38–76 microns | During heating for consolidation | TiN |
| c. 20/25/ Ti alloy permeable aggregate | During heating for consolidation | TiN |
| 2. 20/25/TiN constituents | During heating for consolidation | TiN |
| 3. 20/25* | During heating for consolidation | Nil |
| 4. ODS+ alloy constituents | During heating for consolidation | Oxide eg Yttria |

*For nitrogen alloying without dispersion strengthening by omission of nitride former (Ti)
+ODS = oxide dispersion strengthened (eg Yttria)

I claim:

1. A method of producing a nitrogen-strengthened steel allay, the method comprising heating a combination comprising steel alloy particles containing not more than 0.03% by weight of carbon or a permeable agglomeration thereof and a selected quantity of a nitrogen donor to effect dissociation of a least part of the nitrogen donor, thereby to make a controlled quantity of nitrogen available as a solute in at least some of the particles such that the heated alloy contains between 0.01 and 0.3% by weight of nitrogen in solid solution.

2. A method as claimed in claim 1 wherein the particles include a nitride former.

3. A method as claimed in claim 2 wherein the nitride former is titanium.

4. A method as claimed in claim 1 wherein the particles include a strengthening dispersant.

5. A method as claimed in claim 4 wherein the dispersant is a nitride.

6. A method as claimed in claim 5 wherein the nitride is titanium nitride.

7. A method as claimed in claim 4 wherein the dispersant is an oxide.

8. A method a claimed in claim 7 wherein the oxide is yttria.

9. A method as claimed in claim 1 wherein the nitrogen donor is subjected to mechanical alloying within the particles.

10. A method as claimed in claim 1 wherein the nitrogen donor comprises a metallic nitride which dissociates within the temperature range of 500° C. to 1300° C.

11. A method as claimed in claim 10 wherein the nitrogen donor is a chromium nitride.

12. A method as claimed in claim 1 wherein the combination is subjected to heating at a temperature in excess of 1000° C.

13. A method as claimed in claim 1 wherein particles are heated by hot consolidating.

14. A method as claimed in claim 1 wherein a permeable agglomeration of metal particles is produced by a process comprising atomising a molten stream of the alloy by the use of gas jets and causing the semi-molten particles to impinge on a collector to produce a preform.

15. A method as claimed in claim 14 wherein injecting chromium nitride powder into the atomising gas is performed so as to be dispersed in the preform.

16. A method as claimed in claim 14 wherein the atomising gas comprises a nitrogenous gas and the collector is maintained in a nitrogenous atmosphere.

17. A method of producing a steel alloy by atomising a molten stream of steel alloy particles using gas jets, and causing the semi-molten particles to impinge on a collector to produce a preform, wherein the improvement comprises the alloy particles containing not more than 0.03% carbon by weight, including a selected quantity of a nitrogen donor with the alloy particles, and subsequently heating the preform to effect dissociation of at least part of the nitrogen donor, thereby to make a controlled quantity of nitrogen available as a solute in the preform such that the heated preform contains between 0.01 and 0.3% of nitrogen in solid solution.

18. A method as claimed in claim 17, wherein a nitride former is included with the semi-molten particles, and the selected quantity of the nitrogen donor is such as to form a controlled quantity of nitride in the preform in addition to the nitrogen in solid solution.

19. A method as claimed in claim 17, wherein the quantity of the nitrogen donor is varied during said atomising so as to vary the composition of layers of the preform.

20. A method as claimed in claim 18, wherein the quantity of the nitride former is varied during said atomising so as to vary the composition of layers of the preform.

21. A method as claimed in claim 17, wherein the nitrogen donor comprises chromium nitride.

22. A method as claimed in claim 18, wherein the nitride former comprises titanium.

23. A method as claimed in claim 21, wherein the heating is in excess of 1,000° C.

24. A method as claimed in claim 17, wherein the alloy contains not more than 0.01% by weight of carbon.

25. A method as claimed in claim 1, wherein the alloy contains not more than 0.01% by weight of carbon.

* * * * *